US006267375B1

(12) United States Patent
Bernstein et al.

(10) Patent No.: US 6,267,375 B1
(45) Date of Patent: Jul. 31, 2001

(54) LIFE CHOICES GAME

(76) Inventors: Robin S. Bernstein; Ariel Bernstein, both of 235 Sanford Ave., Palm Beach, FL (US) 33480; Elizabeth Herrick, 10140 Campus Point Dr., San Diego, CA (US) 92121; Marshall Lucas, 500 W. Harbor Dr., San Diego, CA (US) 92101; David Hamby, 444 Zarina La., Encinitas, CA (US) 92024

( * ) Notice: Subject to any disclaimer, the term of this patent is extended or adjusted under 35 U.S.C. 154(b) by 0 days.

(21) Appl. No.: 09/437,806

(22) Filed: Nov. 10, 1999

(51) Int. Cl.[7] ..... A63F 3/02

(52) U.S. Cl. ..... 273/242; 273/236; 273/254; 273/256; 273/308

(58) Field of Search ..... 273/292, 294, 273/308, 242, 236, 244.2, 248, 261, 275, 256, 243

(56) References Cited

U.S. PATENT DOCUMENTS 2,133,515 * 10/1938 Horton, Jr. ..... 273/131
3,643,958 2/1972 Sperber .
4,344,625 * 8/1982 Frudakis ..... 273/242
4,440,396 * 4/1984 Frudakis ..... 273/242
4,480,838 11/1984 Aharonian .
5,013,048 * 5/1991 Turner ..... 273/242
5,503,399 4/1996 Honeywill .

FOREIGN PATENT DOCUMENTS

2646358 * 4/1989 (FR) ..... A63F/3/04

* cited by examiner

*Primary Examiner*—Steven Wong
*Assistant Examiner*—Dolores Collins
(74) *Attorney, Agent, or Firm*—Law Office of Leo Zucker

(57) ABSTRACT

A game that provides choices concerning different life pursuits now available to girls and to persons generally. The game features a game board having a start space, and a number of life paths each of which has spaces marked successively over the length of the path with indicia representing instructions to a player who lands a game piece on a given space. A first set of paths extend away from or about the start space. A second set of paths are choice paths each of which has spaces with indicia relating to a life pursuit, and an entry space and a finish space at opposite ends of the path. The entry and the finish spaces of a given choice path are contiguous with corresponding spaces of one of the first set of paths from which a player can choose to move their playing piece into the entry space of the given choice path. The game may also be provided in CD-ROM or equivalent media form for simulation on a monitor of a personal computer.

18 Claims, 8 Drawing Sheets

LIFE CHOICES GAME

BACKGROUND OF THE INVENTION

1. Field of the Invention

This invention relates to a game that can be played with a game board and playing pieces, or by way of a CD-ROM in connection with a personal computer.

2. Discussion of the Known Art

Current board or computer games for girls and young women do not address the myriad of career and family choices now available to women. Women are no longer limited to selecting only one path leading either to a career or to marriage. Financial success resulting from proper educational and career choices, is only one aspect of importance in a woman's life today. Moreover, the feeling of personal fulfillment upon performing a job especially well tends to be ignored in modern games. And, due in part to increasing numbers of single parent households and two-parent working situations, today's youth often overlook the importance of family as central to holding our society together.

U.S. Pat. No. 5,503,399 (Apr. 2, 1996) is directed to a career game aimed at making persons aware of a number of occupations, and of the necessary qualifications to enter a given occupation. The patented game includes a game board having squares or "compartments". When a player rolls the die and lands their token on a compartment, he or she must define the meaning of a business predicament presented in the square. If correct, the player must answer a question on a selected question card.

U.S. Pat. No. 3,643,958 (Feb. 22, 1972) discloses a game simulating aspects of society. The game includes a board, and various sets of cards relating to public issues and laws. Spaces on the board represent occupations, military positions, agencies and public service positions in government and law. Further, U.S. Pat. No. 4,480,838 (Nov. 6, 1984) discloses a family financial board game in which so-called "fate" and other sets of cards are used during play.

As far as is known, no game is currently available, whether in a game board or CD-ROM form, that enlightens girls and young women to the variety of choices they now have concerning family, careers, investments, and other fulfilling pursuits.

SUMMARY OF THE INVENTION

According to the invention, a game that provides choices concerning a variety of life pursuits available to players of the game, includes a game board with a start space, and a number of life paths each of which has spaces marked successively over the length of the path. The life path spaces have associated indicia representing instructions to a player who lands a playing piece on a given space. A first set of the life paths extend away from or about the start space, and a second set of the life paths are choice paths, each of which has spaces with indicia relating to a fulfilling life pursuit, and an entry space and a finish space at opposite ends of the path. The entry and the finish spaces of a given choice path are contiguous with corresponding spaces of one of the first set of paths, from which a player may choose to move their playing piece into the entry space of the given choice path.

According to another aspect of the invention, the game board and players' moves on the board may be simulated on a monitor of a personal computer, when a storage device such as a CD-ROM containing corresponding program data is used in connection with the computer.

For a better understanding of the invention, reference is made to the following description taken in conjunction with the accompanying drawing and the appended claims.

DETAILED DESCRIPTION OF THE INVENTION

Figure 1:
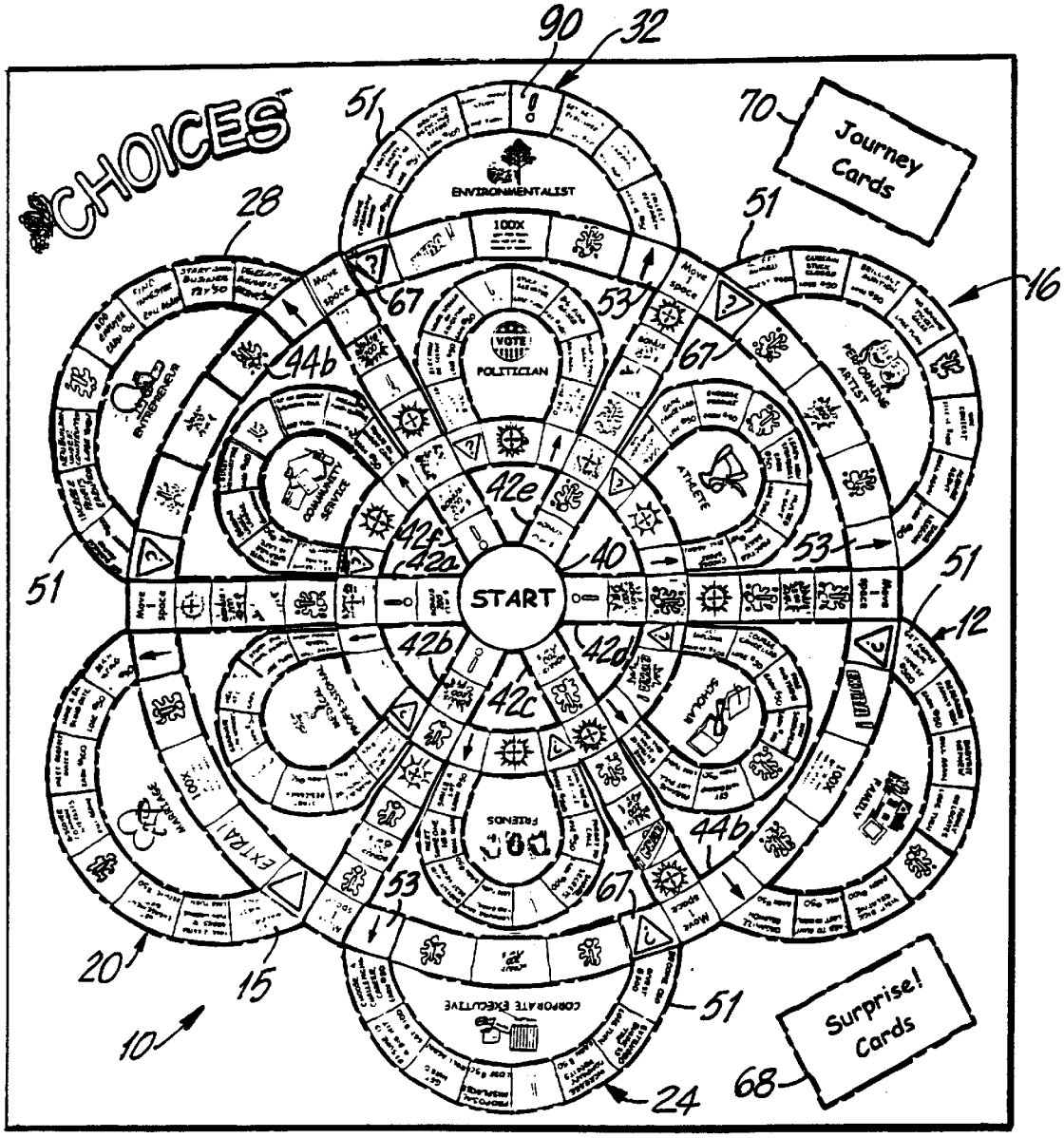
FIG. 1 is a plan view of a life choices game board according to the invention.
Figure 2:
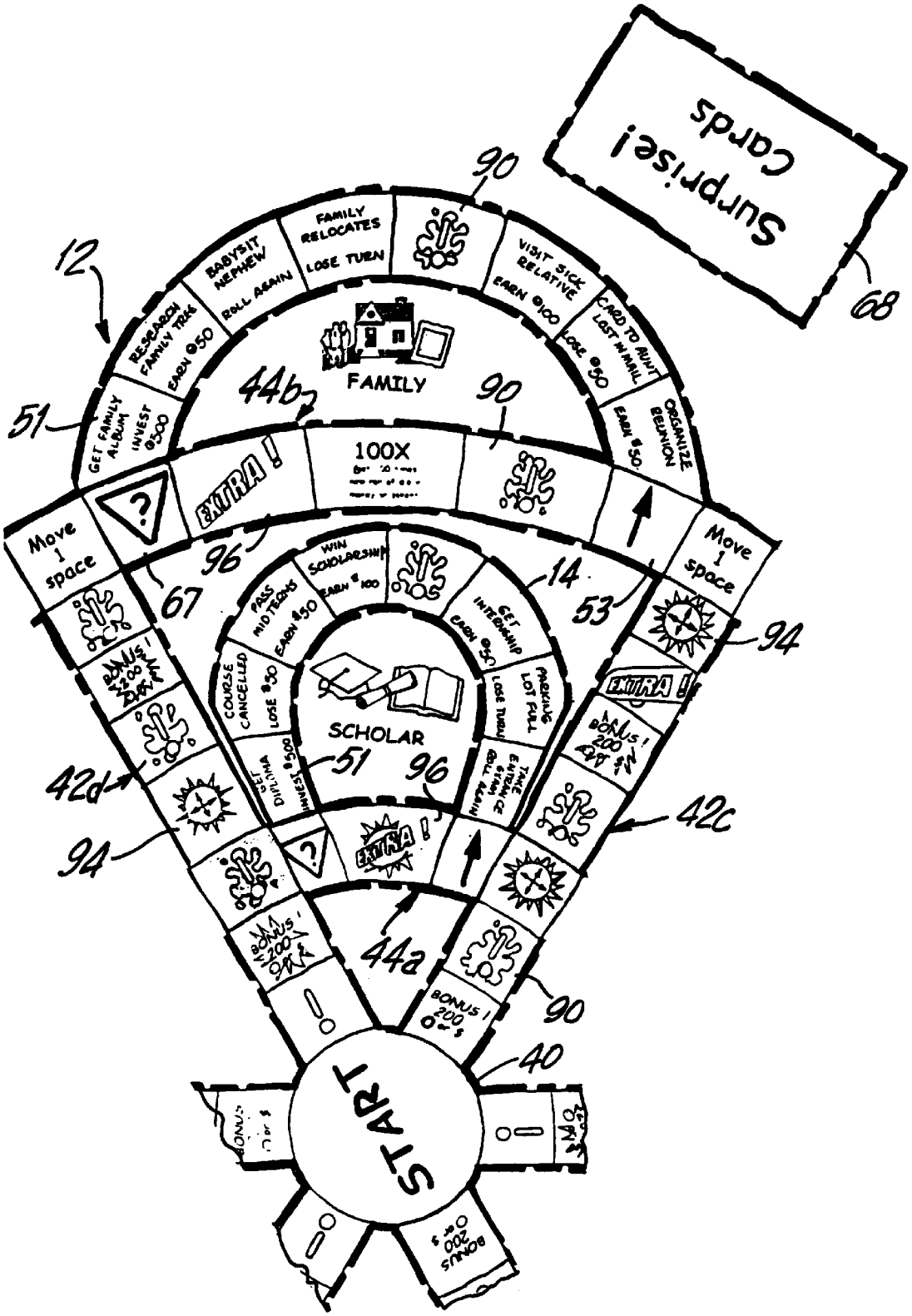
FIG. 2 is an enlarged plan view of a first portion of the game board in FIG. 1.
Figure 3:
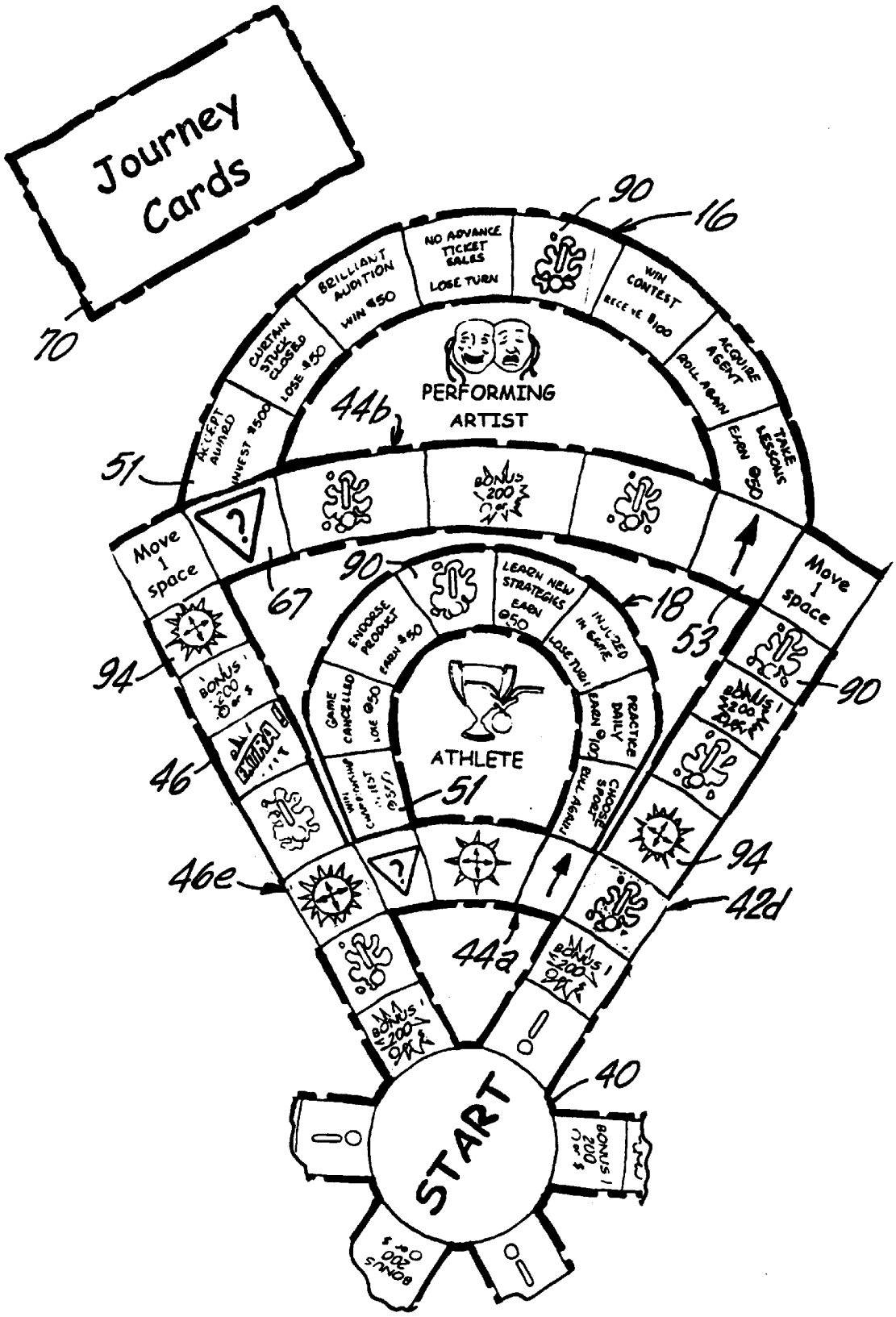
FIG. 3 is an enlarged plan view of a second portion of the game board in FIG. 1.
Figure 4:
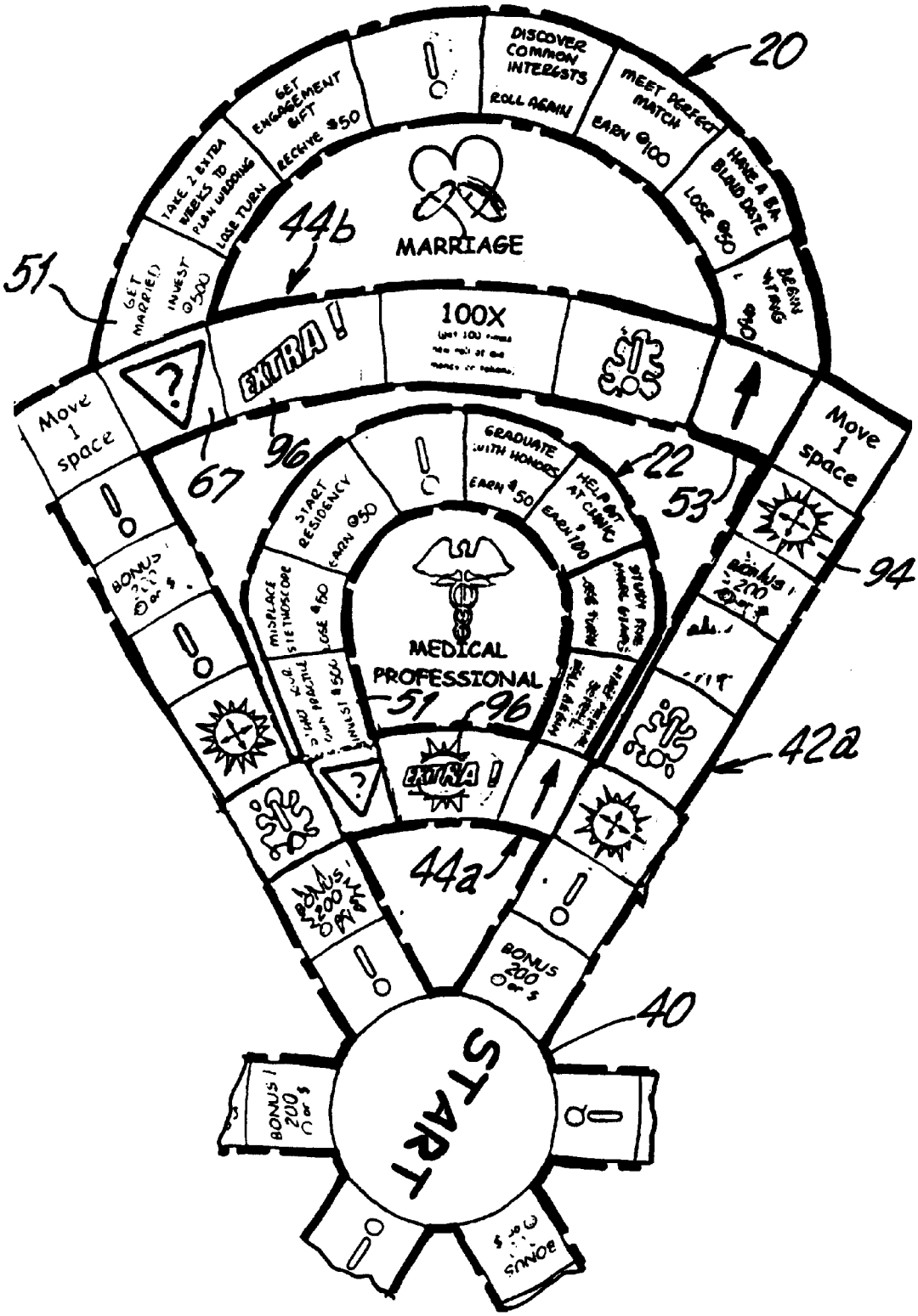
FIG. 4 is an enlarged plan view of a third portion of the game board in FIG. 1.
Figure 5:
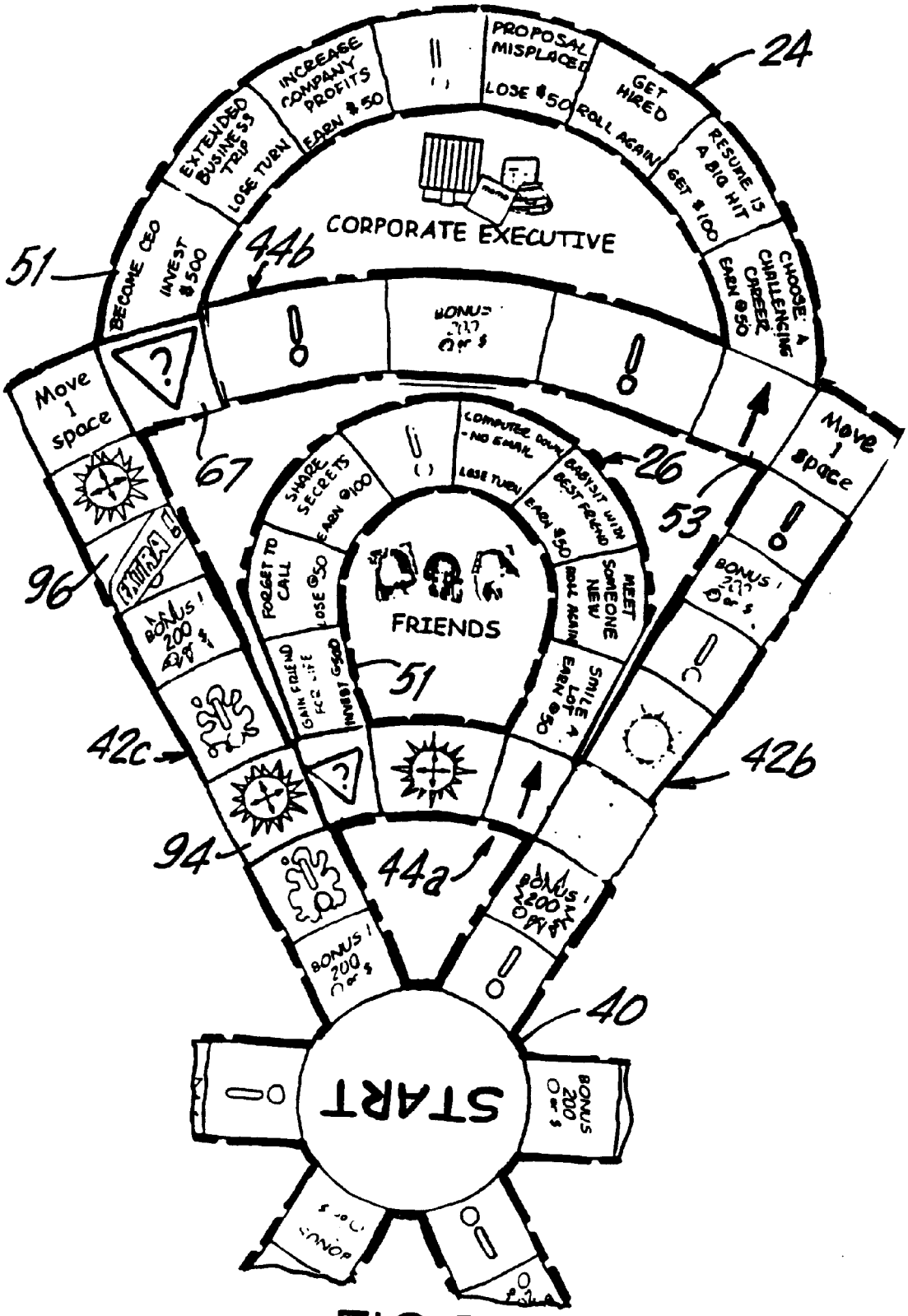
FIG. 5 is an enlarged plan view of a fourth portion of the game board in FIG. 1.
Figure 6:
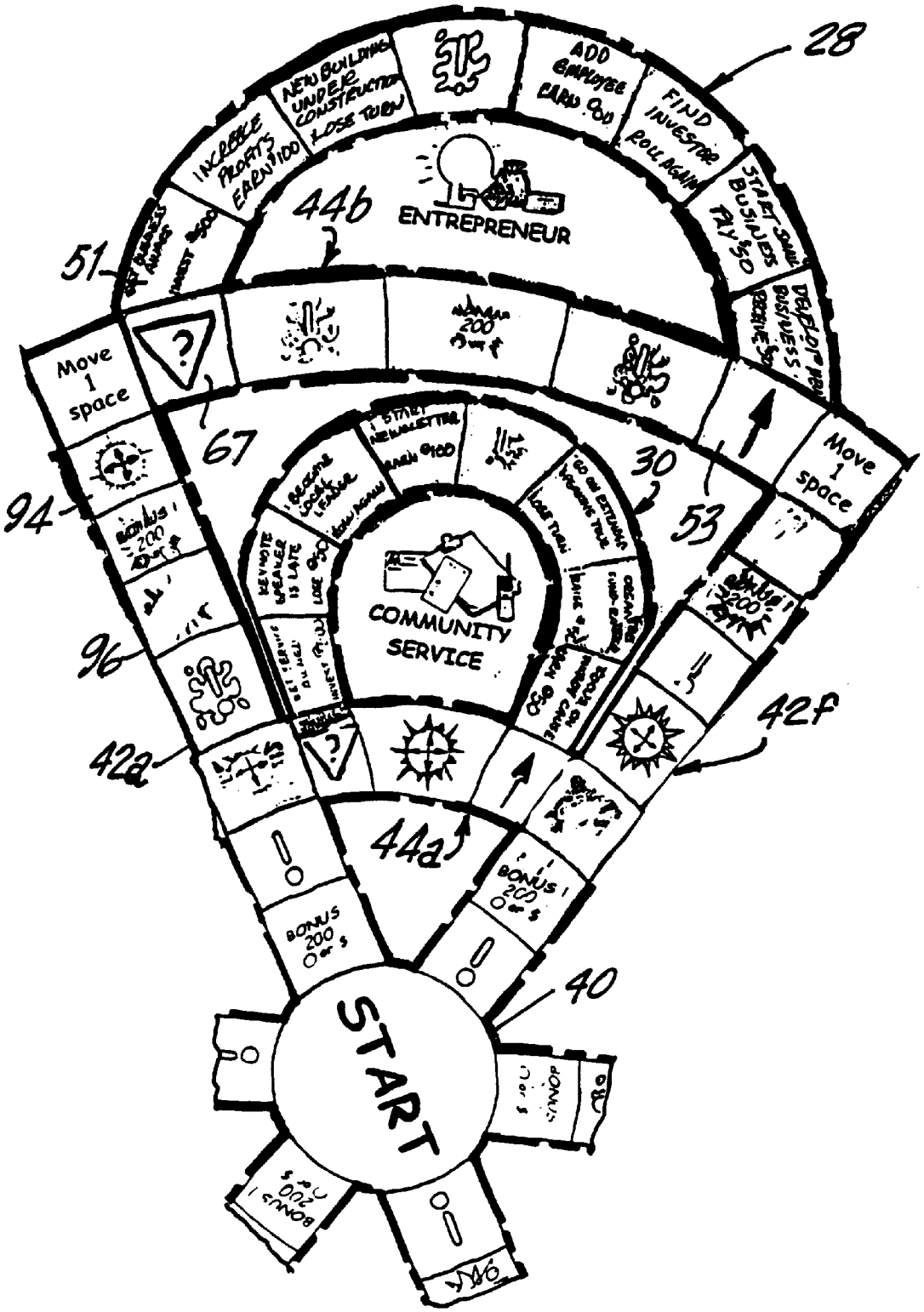
FIG. 6 is an enlarged plan view of a fifth portion of the game board in FIG. 1.

FIG. 1 is a plan view of a life choices game board 10 according to the invention. FIGS. 2–7 are enlarged views of portions of the game board in FIG. 1, and FIG. 8 shows typical playing cards, pieces, "Extra!" photos and play money used during play of the life choices game of the present invention.

In the illustrated embodiment, the present game can be played by up to six players, and the first player to acquire, e.g., six "award" pieces 8 and any six Extra! photos 97 (see FIG. 8) wins the game. Players can pretend that they have just graduated from high school, and must make their own way by availing themselves of certain important choices. The present game provides each player, especially young girls and teens, with an opportunity to explore various paths that life now offers.

Figure 7:
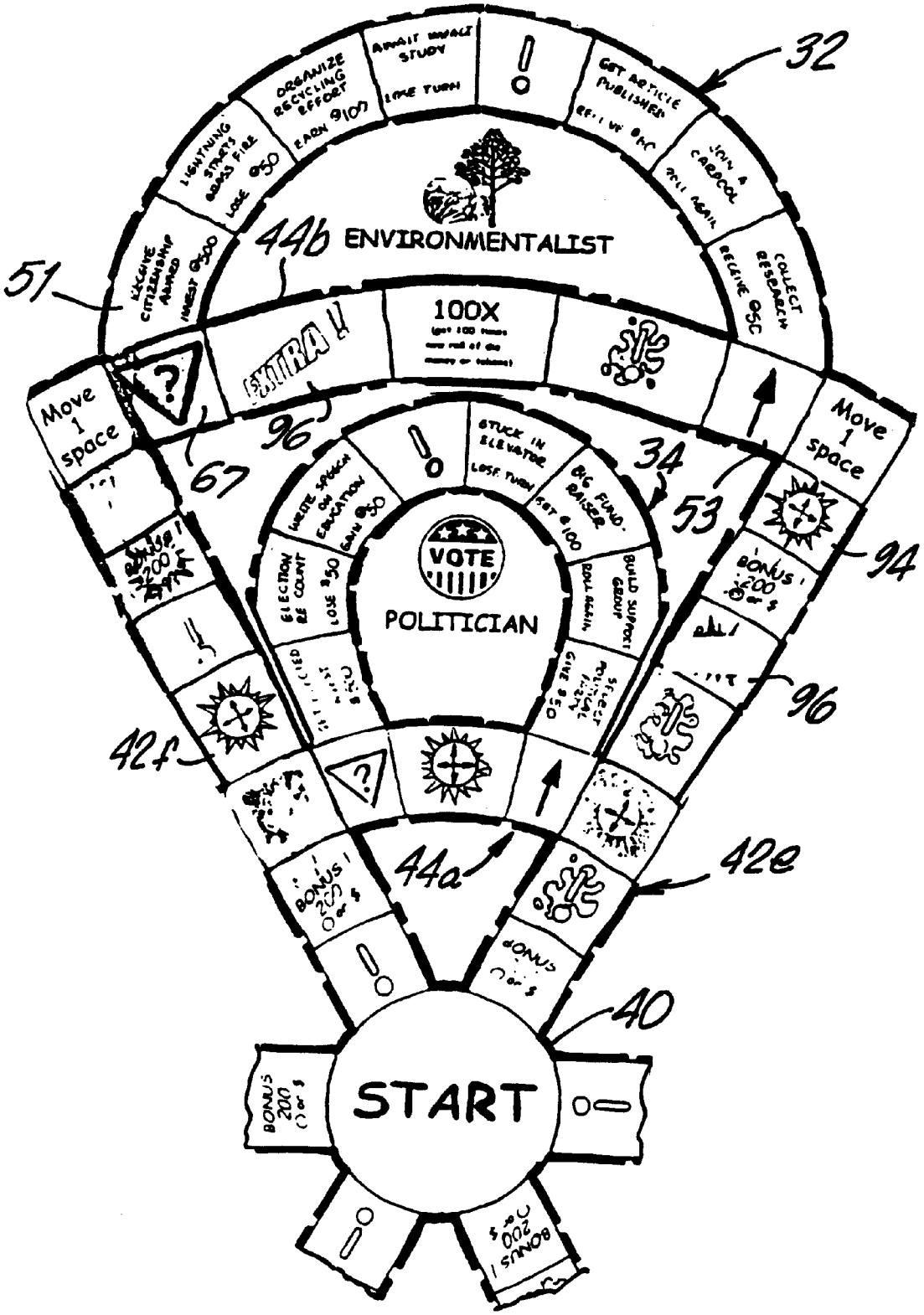
FIG. 7 is an enlarged plan view of a sixth portion of the game board in FIG. 1.
Figure 8:
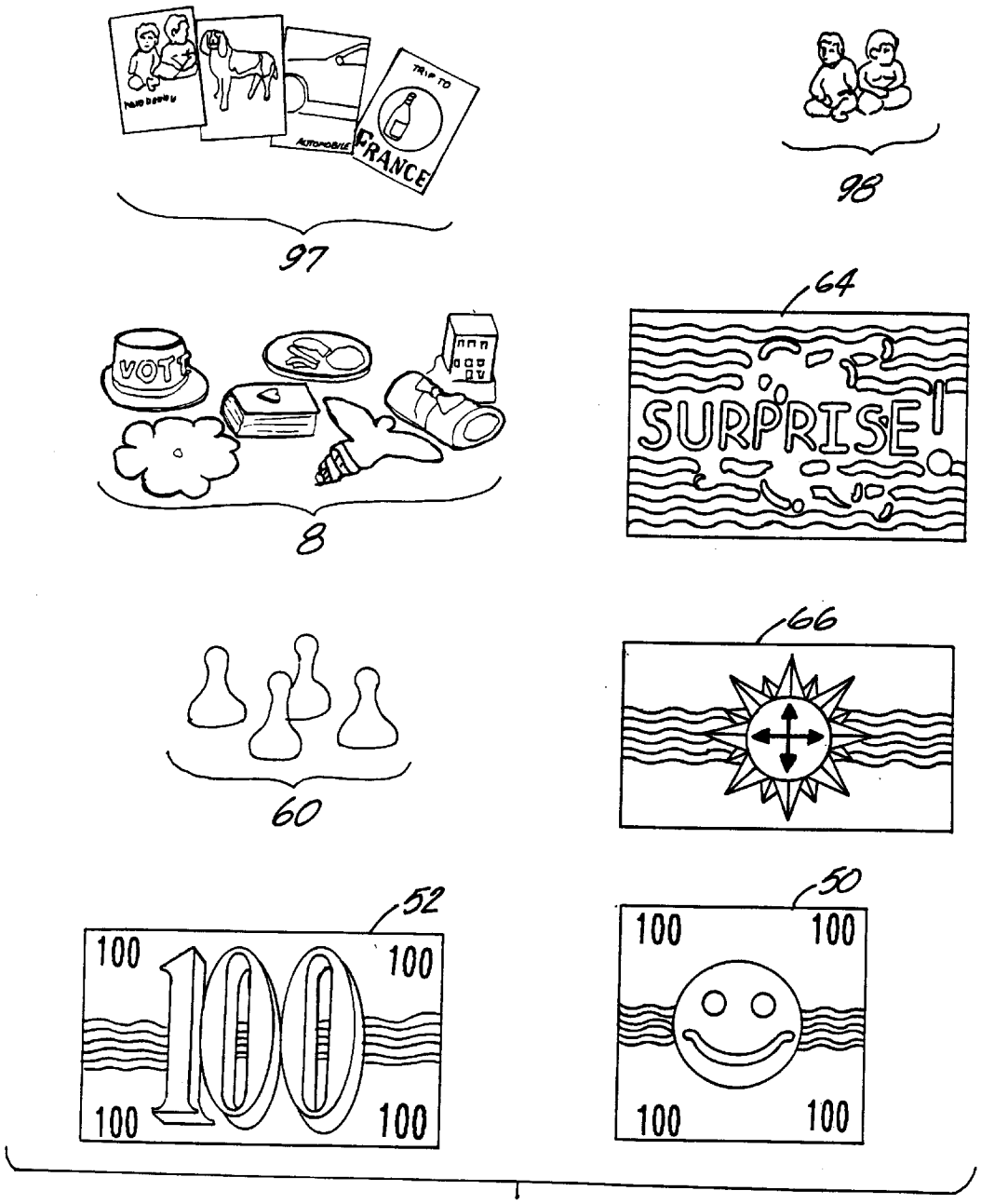
FIG. 8 shows playing cards, pieces, "Extra!" photos and play money used by players of the present game.

In the embodiment of FIG. 1, a game board 10 features a number of life paths including twelve choice paths; namely, family 12 and scholar 14 (FIG. 2), performing artist 16 and athlete 18 (FIG. 3), marriage 20 and medical professional 22 (FIG. 4), corporate executive 24 and friends 26 (FIG. 5), entrepreneur 28 and community service 30 (FIG. 6), and environmentalist 32 and politician 34 (FIG. 7). No one path is accorded more importance or weight during play of the game, than any other path.

The game board 10 also has a start space 40 at or near the center of the board 10. A first set of life paths include, e.g., "straight" paths 42*a*–42*f* that extend away from the start space 40 with equi-angular spacing (e.g., every 30 degrees), and "circular" paths 44*a*, 44*b* which traverse the straight paths 42*a*–42*f*. In the illustrated embodiment, the circular paths 44*a*, 44*b* are concentric with the start space 40 on the game board 10. Further, in the present embodiment, the twelve pursuit choice paths form a second set of life paths each of which is in the form of an open loop whose opposite ends have spaces that are contiguous with corresponding spaces of a given circular path 44*a* or 44*b* of the first set of life paths.

Six of the choice paths, namely, the family path 12, the athlete path 18, the marriage path 20, the friends path 26, the community service path 30, and the environmentalist path 32, each require a player to invest a number of smile points 50 (FIG. 8) when landing on a finish space 51 of each path. The smile points 50 represent a feeling of fulfillment that comes with the successful completion of each of the mentioned six paths. The remaining paths, namely, the scholar path 14, the performing artist path 16, the medical professional path 22, the corporate executive path 24, the entrepreneur path 28, and the politician path 34, each require a player to invest a certain amount of money 52 when landing on the finish space 51 of each of those paths.

The present game begins by providing each player with a collection tray and a game piece 60 (FIG. 8). Each player places their game piece on the start space 40 at the center of the game board 10. A deck of "Surprise!" cards 64 and a deck of "Journey" cards 66, are placed within correspondingly identified spaces 68, 70 on the game board 10 (see FIGS. 1–3 and 8). One player is selected to be the "Banker", and she provides each player with, for example, 1,500 smile points 50, and $1,500 in money 52. The banker is allowed an extra $100 for the job. Denominations of money 52 and smile points 50 may be, for example, in 500's, 100's, and 50's.

Examples of instructions or notices provided on the undersides of the surprise cards 64 may include, but are not limited to, the following:

1. Win $200 from an essay contest.
2. Win $200 at a charity event raffle.
3. Volunteer at a homeless shelter. Earn 200 smile points.
4. Join an aerobics class to stay fit. Earn 50 smile points.
5. Find your neighbor's lost dog. Earn a $50 reward.
6. Earn $100 interest from your savings account.
7. Tutor students in mathematics. Earn $100.
8. Start a reading club. Earn 100 smile points.
9. Help plant trees in a new park. Earn 50 smile points.
10. Help a friend!—Give $50 or 50 smile points to the friend on your right.
11. Have a really bad hair day. Lose 50 smile points.
12. Forget your friend's birthday. Lose 50 smile points.
13. Win a 10K race. Win $200.
14. Step in a giant wad of gum. Lose 50 smile points.
15. You're in the mood for a new hair color. Pay $50 for a purple tint.
16. Invest in an exciting Internet Company! Earn $500.
17. You spend your Thanksgiving Day helping at the Salvation Army serving hot meals. Receive 500 smile points.

The following are examples, without limitation, of instructions or notices provided on the undersides of the journey cards 66. Note that the journey cards relate to a player's movement along a given path.

1. Try out your new bike! Move one space in any direction.
2. Go for a brisk walk. Move one space in any direction.
3. Lace up your running shoes! Move one space in any direction.
4. Go rock climbing. Move two spaces in any direction.
5. Learn how to water-ski. Move two spaces in any direction.
6. Go wind surfing. Move three spaces in any direction.
7. Rev up your race car. Move three spaces in any direction.
8. Your flight is delayed. Go back to start.
9. A broken fan belt! Go back to start.
10. Win a free flight. Roll again.
11. Ride the subway. Roll again.
12. No traffic today! Roll again.

A number of journey cards 66, when drawn, may also allow a player to choose either to jump between "Decision Point" spaces 67 marked along various paths on the game board 10 (see FIGS. 2–7), or to remain on their present path. Such cards, for example, carry the following instruction:

"You choose! Jump to any Decision Point and collect 50 smile points, or stay where you are."

To start the game, each player rolls a single die. Typically, the player with the highest number begins. The order of the remaining players' turns may be determined by their rolled numbers or other agreed order, e.g., rotating toward the right of the starting player. The starting player rolls the die again, and moves forward from the start space 40 along a chosen one of the straight paths 42*a*–42*f*. A player may turn left or right on upon crossing one of the circular paths 44*a*, 44*b*, but, upon doing so, must continue to move in the same "forward" direction. That is, a player may not reverse their direction of movement along any of the first set of paths, unless directed to do so by a journey card 66.

When landing on a space along the first set of paths 42*a*–42*f*, 44*a*–44*b*, the player follows directions given by the indicia associated with the landed space. Movement is permitted back across the start space 40, provided such movement is a forward one at the time for the player.

Two or more players may not occupy any one space on the board 10 at the same time. If the die shows a number of spaces that would land one player on the same space as another player, the one player may either roll again, or exchange places by moving the other player's piece to the space presently occupied by the one player.

In order for a player to collect an award piece 8, she must enter the corresponding choice path from an associated circular path 44*a* or 44*b*, complete the entered choice path and invest the amount of smile points 50 or money 52 indicated at the finish space 51 of the choice path. Unlike moves along the first set of paths on the board 10, a player may move her playing piece in either direction along a choice path, much as in real life. Upon a player's turn, she may arrange for a loan from another player to complete an entered choice path, but only at the other players' option. Interest on the loan is negotiable, but a player cannot win the game if she is in debt.

A player may enter more than one choice path from contiguous entrance spaces 53 on the circular paths 44*a* or 44*b*, to acquire up to six award pieces. The player may not complete the same choice path more than once, however. Regardless of the roll of the die, a player must stop at the finish space 51 of a choice path to receive the corresponding award piece 8 in exchange for the required investment of smile points 50 or money 52, before she may cross a "red line" to enter a contiguous decision point space 67 on the associated circular path 44*a* or 44*b*.

If, upon landing on the finish space 51 of a choice path a player lacks the number of points or money indicated in the space, she must return to the start space 40 or try to convince another player to loan her the necessary money/points to complete the path. Interest on the loan is negotiable but a player may not win the game if she is in debt. A player may also acquire money or smile points by landing on a "Surprise" space 90 (see below) along the choice path, drawing a surprise card 64, and winning or earning a stated amount of points or money.

Each player may borrow only 500 smile points or $500 of money from the banker during her turn; no more, no less. To repay the loan, 10% interest is charged. The banker maintains an account of all debts, and a player may not win the game if she is in debt.

The following spaces are provided along the paths on the game board 10:

"Surprise!" spaces 90. When landing on a surprise space 90, a player draws the top surprise card 64 on the deck at 68, and follows the instructions on the card. If she lacks enough money or smile points to follow the instructions on the surprise card, she must take a loan from the bank, or go back to the start space 40. Certain surprise cards allow a player to choose a baby token 98 as a bonus. A player may not choose a baby token unless she has completed the marriage path 20 on the game board 10.

Journey spaces 94. When a player lands on a journey space 94, she draws the top journey card 66 and follows the instructions on the card.

"Extra!" spaces 96. If a player lands on an extra space 96, she may place for auction any of a number of "extras" that life sometimes delivers. These items are valued life assets, e.g., a boat, jewelry, loyalty, compassion, a car, and the like, and are represented by individual photo or image cards 97 (FIG. 8). The other players may bid money for extra cards 97 representing properties such as a car, a boat, jewelry or the like; or bid smile points for cards 97 representing compassion, loyalty, integrity or the like. A player who lands on an extra space 96 starts the bidding on any remaining Extra! card 97 of her choice. The highest bidder wins, and keeps the card in her collection tray.

The first player to collect six award pieces and six extra cards wins the game. The remaining players may continue to play if they so choose.

While the foregoing description represents a preferred embodiment of the invention, it will be obvious to those skilled in the art that various changes and modifications may be made, without departing from the spirit and scope of the invention pointed out by the following claims. For example, a CD-ROM or equivalent media can be produced which, when combined with a personal computer and monitor, will cause the monitor to display the game board 10 and allow players to interact with the display according to the rules of the present game. Programs and data to be included in the media would be apparent to one skilled in the art with the benefit of the present disclosure.

We claim:

1. A game that provides choices concerning a variety of life pursuits available to players of the game, comprising:

a game board having a start space, and a number of life paths each of which has spaces marked successively over the length of the path, wherein the life path spaces have associated indicia representing instructions to a player who lands a playing piece on a given space;

wherein a first set of life paths extend away from or about the start space;

a second set of life paths are choice paths, each of which has spaces with indicia relating to a fulfilling life pursuit, and an entry space and a finish space at opposite ends of the path; and wherein the entry and the finish spaces of a given choice path are contiguous with corresponding spaces of one of the first set of paths from which a player can choose to move their playing piece into the entry space of the given choice path.

2. A life choices game according to claim 1, wherein one of said choice paths has spaces with associated indicia relating to family.

3. A life choices game according to claim 1, wherein one of said choice paths has spaces with associated indicia relating to scholarship.

4. A life choices game according to claim 1, wherein one of said choice paths has spaces with associated indicia relating to performing arts.

5. A life choices game according to claim 1, wherein one of said choice paths has spaces with associated indicia relating to athletic sports.

6. A life choices game according to claim 1, wherein one of said choice paths has spaces with associated indicia relating to marriage.

7. A life choices game according to claim 1, wherein one of said choice paths has spaces with associated indicia relating to medicine.

8. A life choices game according to claim 1, wherein one of said choice paths has spaces with associated indicia relating to corporate affairs.

9. A life choices game according to claim 1, wherein one of said choice paths has spaces with associated indicia relating to friendship.

10. A life choices game according to claim 1, wherein one of said choice paths has spaces with associated indicia relating to entrepreneurship.

11. A life choices game according to claim 1, wherein one of said choice paths has spaces with associated indicia relating to community service.

12. A life choices game according to claim 1, wherein one of said choice paths has spaces with associated indicia relating to environmentalism.

13. A life choices game according to claim 1, wherein one of said choice paths has spaces with associated indicia relating to politics.

14. A game according to claim 1, wherein some of the life path spaces are surprise spaces marked with associated indicia, and including a deck of surprise cards each of which, when drawn by a player who lands a playing piece on a surprise space, rewards the player with a stated amount of play money, smile points, or a baby token.

15. A game according to claim 1, wherein some of the life path spaces are journey spaces marked with associated indicia, and including a deck of journey cards each of which, when drawn by a player who lands a playing piece on a journey space, instructs the player with respect to their movement along a given path or to other spaces on the game board.

16. A game according to claim 1, including a number of award pieces, and the indicia associated with the finish spaces of the choice paths direct a player to receive a corresponding award piece.

17. A game according to claim 1, where some of the lift path spaces are marked as "extra" spaces, and including a set of corresponding extra cards each of which represents a valued life asset.

18. A CD-ROM that includes such programs and data so that, when operatively coupled with a personal computer having an associated monitor, the game board of the life choices game according to claim 1 is displayed on the monitor.

* * * * *